US006442865B1

(12) United States Patent
Wolf et al.

(10) Patent No.: US 6,442,865 B1
(45) Date of Patent: Sep. 3, 2002

(54) DRYING SECTION

(75) Inventors: Robert Wolf, Herbrechtingen; Markus Oechsle, Bartholomae; Wolfgang Mayer; Tri Chau-Huu, both of Heidenheim; Thomas Mack, Sontheim; Roland Mayer, Heidenheim, all of (DE)

(73) Assignee: Voith Sulzer Papiertechnik Patent GmbH, Heindenheim (DE)

( * ) Notice: Subject to any disclaimer, the term of this patent is extended or adjusted under 35 U.S.C. 154(b) by 0 days.

(21) Appl. No.: 09/621,655

(22) Filed: Jul. 21, 2000

(30) Foreign Application Priority Data

Jul. 27, 1999 (DE) ..... 199 35 138

(51) Int. Cl.[7] ..... F26B 11/02

(52) U.S. Cl. ..... 34/114; 34/115; 34/122; 34/619; 34/635; 34/662; 34/663

(58) Field of Search ..... 34/115, 116, 122, 34/123, 619, 629, 635, 662, 663; 162/207, 206, 359.1

(56) References Cited

U.S. PATENT DOCUMENTS

| | | | | |
|---|---|---|---|---|
| 3,163,502 A | * | 12/1964 | Justus et al. | 34/114 |
| 3,874,997 A | | 4/1975 | Kankaanpää | |
| 4,036,684 A | | 7/1977 | Schmitt et al. | |
| 4,361,466 A | | 11/1982 | Wong et al. | |
| 4,462,868 A | | 7/1984 | Outbridge et al. | |
| 5,495,678 A | | 3/1996 | Ilmarinen et al. | |
| 5,653,041 A | | 8/1997 | Ilmarinen et al. | |
| 5,699,626 A | * | 12/1997 | Chuang et al. | 34/453 |
| 5,865,955 A | * | 2/1999 | Ilvespaaet et al. | 162/207 |
| 5,942,085 A | * | 8/1999 | Neal et al. | 162/111 |
| 6,004,430 A | | 12/1999 | Ilvespää et al. | |
| 6,098,309 A | * | 8/2000 | Halmschlager et al. | 34/420 |
| 6,119,362 A | * | 9/2000 | Sundqvist | 34/120 |
| 6,294,050 B1 | * | 9/2001 | Oechsle et al. | 162/207 |

FOREIGN PATENT DOCUMENTS

| | | |
|---|---|---|
| DE | 2203621 | 8/1973 |
| DE | 3215515 | 11/1982 |
| DE | 19651191 | 6/1998 |
| EP | 0620313 | 10/1994 |
| WO | 01/00925 | 1/2001 |

* cited by examiner

*Primary Examiner*—Denise L. Esquivel
*Assistant Examiner*—Mark Shulman
(74) *Attorney, Agent, or Firm*—Greenblum & Bernstein, P.L.C.

(57) ABSTRACT

Drying section of a machine for producing a material web. The drying section includes a support roll with an associated impingement dryer, and at least one straight or curved section forming at least a part of a closed path between a last nip of a press section adjacent the drying section and the support roll. The support roll and the impingement dryer are arranged to guide the material web over the support roll, and, thereby, to subject the material web to at least one of hot air and hot steam impingement. The at least one straight or slightly curved section is structured and arranged to form at least one of an impingement drying section and a transfer foil section.

30 Claims, 9 Drawing Sheets

DRYING SECTION

CROSS-REFERENCE TO RELATED APPLICATIONS

The present application claims priority under 35 U.S.C. § 119 of German patent application No. 199 35 138.4, filed on Jul. 27, 1999, the disclosure of which is expressly incorporated by reference herein in its entirety.

BACKGROUND OF THE INVENTION

1. Field of the Invention

The invention relates to a drying section of a machine for producing a material web, e.g., a paper or cardboard web.

2. Discussion of Background Information

In conventional multi-cylinder drying sections, the paper web to be dried is guided over a number of steam-heated cylinders or over a configuration involving a number of steam-heated cylinders and screen suction rolls. Particularly at the outset of drying, when the paper web still lacks adequate strength, there are frequently problems with respect to web guidance, which can be attributed in particular to the fact that the still-moist web continues to stick to the smooth contact areas, areas that are urgently necessary for adequate heat transfer. These problems can be reduced by coating the cylinders. Relatively high tension forces are therefore necessary, though this frequently leads to web tears and overstretching of the web edges. Therefore, as a rule, therefore, it is necessary for the drying to proceed more slowly, i.e., with, for example, a lower steam pressure at the beginning, and this means that the required drying section becomes longer overall. The problems discussed above arise to a greater degree at high web speeds.

SUMMARY OF THE INVENTION

The present invention relates to a drying section of the type described at the outset which, at high machine speeds, provides as optimal a drying rate as possible at the beginning of drying, as well as a secure guidance of the web.

Accordingly, the material web, starting at the last press nip of a press section, is conducted in a closed path over at least one straight or slightly curved section, to a larger support roll with an assigned impingement dryer, which is, arranged to subject the material web to an impingement of hot air or hot steam, as it is guided over the support roll. The straight or slightly curved section is provided in the form of an impingement drying section and/or a transfer foil section.

With this design, it is no longer necessary to guide the still relatively moist material web over smooth contact surfaces in order to achieve adequate heat transfer. Because smooth contact areas are avoided at the beginning of drying, the danger of tears in the web and overstretching of the web edges is practically eliminated. Higher drying rates, in particular, are now possible, and this in turn shortens the overall length of the drying section. In principle, impingement drying can also take place in any given transfer foil section. This kind of transfer foil section can be provided in the form of a simple transfer section.

In a preferred embodiment of the drying section according to the invention, the material web is supported at least in the area between the last press nip of the press section, or the removal from the press felt or press belt belonging to the last press nip, and the support roll, by an open, i.e., not smooth, support surface which can be formed, e.g., by a continuous belt or screen. Here, the material web is preferably also supported in the area of the impingement dryer assigned to the support roll by an open, i.e., not smooth, support area, which is being formed either by the surface, or coating or cover, of the support roll or by the surface of a continuous belt or screen guided over the support roll.

It is advantageous for the support roll to have an outer diameter ranging from about 2.5 to about 8 m, and preferably ranging from about 3 to about 5 m.

In a useful practical embodiment, the support roll assigned to the impingement dryer is provided with suction, and a continuous screen is guided over the support roll in order to hold the material web in place. This can be done directly by a suction box located within the device or through openings provided in the jacket surface by an external suction box. When the diameter increases, not only does the circumference of the support roll increase, but the possible angle of wrapping covered by the impingement dryer also increases, and thus the drying area. The impingement dryer can lie above or below the cylinder plane and can be moved for the purpose of transfer and/or cleaning, especially in parts. When the support roll is provided with suction, the roll and the corresponding suction box can contain narrow transfer zones for the purpose of strip transfer.

If impingement flow drying occurs not only in the area of at least one larger support roll but also in that of the straight or slightly curved section, the major part of the impingement drying is ideally taken over by the impingement dryer assigned to the larger support roll.

In principle, a plurality of impingement dryers, each assigned to a given support roll, can also be provided.

In a useful practical embodiment, the material web, following at least one impingement dryer assigned to a given support roll, is conducted to a drying group with at least one drying cylinder. Here, the material web can be fully dried in a single-row or double-row drying group.

On reaching or leaving the first drying cylinder or upon being withdrawn from a smooth heated surface, the material web ideally will already have a dryness content that is greater than about 55 to 65% wt. It is thus possible to avoid pulling the web from a smooth heated area during the time the web has a dryness content of less than about 55 to 65% wt.

In a preferred practical embodiment of the drying section according to the invention, the material web can be moved in the web travel direction and into the cellar, at a point in front of the support roll following the straight or slightly curved impingement drying or transfer-foil section with the assigned impingement dryer, i.e., it can be moved out of the machine (e.g., into the pulper). Thus, refuse removal is provided after the press section.

Here, the material web can be moved into the cellar, e.g., at a point immediately beyond an initial (as viewed in the web travel direction) straight or slightly curved impingement drying section or transfer-foil section.

Alternatively or additionally, the material web can also be moved into the cellar in the vicinity of a pickup roll by which the material web can be removed from a press felt or press belt guided through the last press nip of the press section when the material web is not being conducted into the drying section by the preceding pickup roll.

In certain cases, it is also advantageous if the material web can be moved into the cellar in the area of an additional press roll which lies opposite a deflection roll which is provided for a press felt guided through the last press nip and which is located behind the last press nip of the press section.

As an alternative, the web can also be moved into the cellar in the area of a smooth removal roll which is encircled by the last press felt or belt in such a way that the web runs in conjunction with the roll. A removal scraper is preferably installed on this roll.

It is useful to provide at least one straight or slightly curved impingement drying section or transfer-foil section in which the material web is guided between two screens. In a corresponding straight or slightly curved impingement dryer section or transfer-foil section the material web can be exposed to impingement while passing through the upper screen and/or the lower screen. The screen provided on the blow side should be resistant to high temperatures and be as permeable as possible to the impingement. The material web and the two screens can be supported, e.g., by support rolls, which are only encircled to the extent necessary for paper damage not to arise due to sheering, e.g., an angle of wrapping in a range from about 2° to about 10° can be provided, particularly from about 3° to about 7°. When there is a plurality of impingement dryers, which can be provided in the form of, e.g., impingement boxes, the blow side can be alternated.

In principle, at least one straight or slightly curved impingement dryer section or transfer foil section can be provided in which the material web is held onto a screen by transfer foils. The second or covering screen can be eliminated. If there is impingement drying on this kind of section, blowing can occur directly from the given impingement dryer or impingement box onto the material web. The given transfer foil section can also be provided as a pure transfer section, however, without impingement drying.

The impingement drying or transfer foil sections can run horizontally or at an incline.

A web cut between the press section and the first larger support roll with its assigned impingement dryer can be performed, e.g., following the, first double-screen section, from a screen into the pulper by a movable roll and supported by water or air jets positioned behind the screen; or by another pickup roll at an additional removal point at a second lower felt; or by another press nip, namely at an opened pickup point into the drying section.

In certain cases, it is useful for at least two impingement dryers positioned on the same side of the material web to be provided. Here, at least one such impingement dryer can also be assigned to a straight or slightly curved impingement drying section or transfer foil section.

In certain cases, it is also useful for at least two impingement dryers to be provided on different sides of the material web. Here, too, at least one impingement dryer can be assigned to a straight or slightly curved impingement drying section or transfer foil section.

In a useful embodiment, at least one straight or slightly curved impingement drying or transfer foil section is provided between two impingement dryers, each of which is assigned a support roll.

In certain cases, it can be useful for at least one impingement dryer to be provided in an area other than the direct starting area of the drying section, i.e., following one or several drying cylinders belonging to the drying section.

Particularly in the case of several large support rolls with assigned impingement dryers, drying can be performed in an alternating manner, or it can always be performed from the same side and a transfer between the larger support rolls can be made through a straight or slightly curved impingement drying section or transfer foil section.

It is advantageous for at least one impingement dryer to be provided with at least one dryer hood.

In a preferred practical embodiment of the drying section according to the invention, the material web is delivered from a screen belonging to a straight or slightly curved impingement drying section or transfer foil section to a screen conducted over the support roll, e.g., the delivery area can be provided with suction by a suction box that is provided in front of or upon the support roll.

It can be useful for air that is entrained by the screen to be stripped in front of the intake into the nip, which is possible, e.g., with a flexible blade, or the air can be provided with suction from the box in a preliminary zone. In addition, the removal can be supported by blow jets that either blow on the web through the screen, e.g., in the case of blow jets integrated into the small suction roll or into the intermediate space thereafter, or by blow jets that operate from the hood rim and blow the web to the large support roll, which is provided with suction. One part of the small suction roll can take the form of an overpressure zone; or an overpressure box can be installed in the intermediate space, in order to push the web back away from the preceding screen.

In an alternative and useful embodiment, a screen assigned to a straight or slightly curved impingement drying section or transfer foil section is simultaneously guided over the support roll while, in the area of a guide or blow roll, the material web is brought up onto the support roll.

Thus the material web can be guided, for example, directly onto the large support roll, which is preferably provided with suction, via a web-guiding roll or via a blow roll which assures that the web is successfully detached. In front of the web approach point, the guide roll can be outfitted with jets which produce an air pillow and thus assure optimal removal of the web. The jets can be integrated into a scraper. In the case of a blow roll, the latter can be covered with a screen stocking.

When the hood is positioned below, the material web can, after the larger support roll with the screen is reached, be guided directly onto an unheated web-guiding roll or a drying cylinder. The scraper should be combined with a deflection sheet or with the hood in such a way that, even when the hood is open, paper does not fall from the scraper into the hood or result in blockages. The web-guiding roll can also take the form of, e.g., a blow roll, possibly with a screen stocking, which results in easy removal of the web.

When the hood is positioned above, the removal of the material web from the screen of the larger support roll can be performed with a suction roll, namely in such a way that, when there is a tear, paper can fall between the screens into the cellar.

The transfer between two support rolls that are provided with suction and positioned in succession can occur in an analogous fashion.

In a given instance of impingement drying, the following impingement conditions can apply, e.g., blow temperature about 200 to 400° C., air speed about 70 to about 140 m/s, preferably about 90 to 120 m/s, distance from the impingement dryer or the hood about 10 to about 70 mm, preferably about 30 to about 50 mm. The air speed can be varied according to zones for the sake of cross-profiling, which also applies to the air temperature and moisture. In addition, the conditions in the different boxes and hoods, and in the longitudinal areas, can be differently adjusted, e.g., in order to permit the temperature in the dual-screen area to be adjusted to the load capacity of the screen or to permit a lower moisture to be selected, so as to avoid condensation when the material web is insufficiently warm. For the sake of effective energy usage, the blown air can be guided in cascade fashion. The impingement hoods on one or a plurality of large support rolls perform the major part of the impingement drying. Instead of hot air, superheated steam can also be used as a drying medium. In principle, the use of both media is possible.

Depending on the diameter of the larger support roll, it may be advantageous if some of the subsequent drying cylinders are positioned at a lower level. To further increase the output in the main vaporization process, further impingement dryers or impingement hoods can be inserted in the area of the cylinder drying section, specifically on larger suction rolls above or below the cylinder plane. The individual larger support rolls can have differing diameters. If the refuse removal following the press is not performed with a second pickup roll on the last press felt, but rather on a straight or slightly curved impingement drying section or transfer foil section, then any embodiment variant can be combined with the material web being removed from an upper press felt. Additional IR emitters for rapid heating can be installed in the straight area where the impingement hood begins.

The present invention is directed to a drying section of a machine for producing a material web. The drying section includes a support roll with an associated impingement dryer, and at least one straight or curved section forming at least a part of a closed path between a last nip of a press section adjacent the drying section and the support roll. The support roll and the impingement dryer are arranged to guide the material web over the support roll, and, thereby, to subject the material web to at least one of hot air and hot steam impingement. The at least one straight or slightly curved section is structured and arranged to form at least one of an impingement drying section and a transfer foil section.

According to a feature of the instant invention, the material web can include one of a paper and cardboard web.

In accordance with another feature of the invention, one of a continuous belt or screen can be arranged to form an open support area, at least in an area between the last press nip and the support roll. Further, the open support area is not smooth.

In accordance with still another feature of the present invention, another open support area can be formed in an area of the impingement dryer. The another open support area may be formed one of by the surface, covering or coating of the support roll and by a surface of a one of a continuous belt and screen guided over the support roll.

The support roll can have an outer diameter in a range between about 2.5 to about 8 m, preferably, the support roll has an outer diameter in a range between about 3 to about 5 m.

According to a further feature of the invention, a plurality of impingement dryers can each be associated with a support roll.

Further, a dryer section can include at least one drying cylinder which is arranged downstream from the support roll, relative to a web run direction.

The material web, upon one of leaving the first drying cylinder and being drawn from a smooth heated surface, can have a dryness content that is greater than about 55 to about 65% wt.

In accordance with another feature of the invention, a cellar may be positioned in front of the support roll, relative to a web run direction. Further, the cellar may be arranged to follow the at least one straight or slightly curved section, relative to a web run direction. Still further, an additional pick-up roll can be arranged to transport the material web into the cellar. The material web may be removed from one of a press felt guided through the last press nip and a press belt. The press belt is one of an open and closed belt. Further still, an additional press roll and a deflection roll can be arranged opposite each other. The deflection roll may be located within a press felt loop which passes through the last press nip, and the additional press roll may be arranged to transport the material web from the press felt to the cellar. A smooth removal roll can be encircled by one of a press felt and a press belt may be guided through the last press nip and that is arranged to transport the material web into the cellar.

According to a still further feature of the instant invention, the at least one straight or slightly curved section may include two screens arranged such that the material web is guided through the two screens.

Moreover, the at least one straight or slightly curved section can include a screen and transfer foils, which are arranged to hold the material web onto the screen.

In accordance with still another feature of the present invention, the support roll may include a suction roll and a narrow strip transfer zone. The suction roll can be coupled to one of an internal suction box and an external suction box.

According to another feature of the instant invention, at least two impingement dryers can be positioned on a same side of the material web.

In accordance with still another feature of the present invention, at least two impingement dryers can be positioned on different sides of the material web.

The at least one straight or slightly curved section can be arranged between two impingement dryers which are each assigned to a support roll.

Further, the at least one impingement dryer may be arranged in an area which is not at a direct starting area of the drying section. The at least one impingement dryer can be arranged only after at least one a plurality of drying cylinders.

According to a further feature of the invention, the at least one impingement dryer may include at least one dryer hood. The at least one hood can be swivelable. The swivelable hood can be coupled to a tear control system.

In accordance with a still further feature of the present invention, the at least one straight or slightly curved section can include a screen and the material web is transferred from the screen to a support roll screen guided over the support roll. A transfer area includes a suction box arranged one of in front of and on the support roll.

In accordance with yet another feature of the present invention, the at least one straight or slightly curved section can include a screen which is simultaneously guided over the support roll. The material web can be guided onto the support roll in an area of one of a guide and blow roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
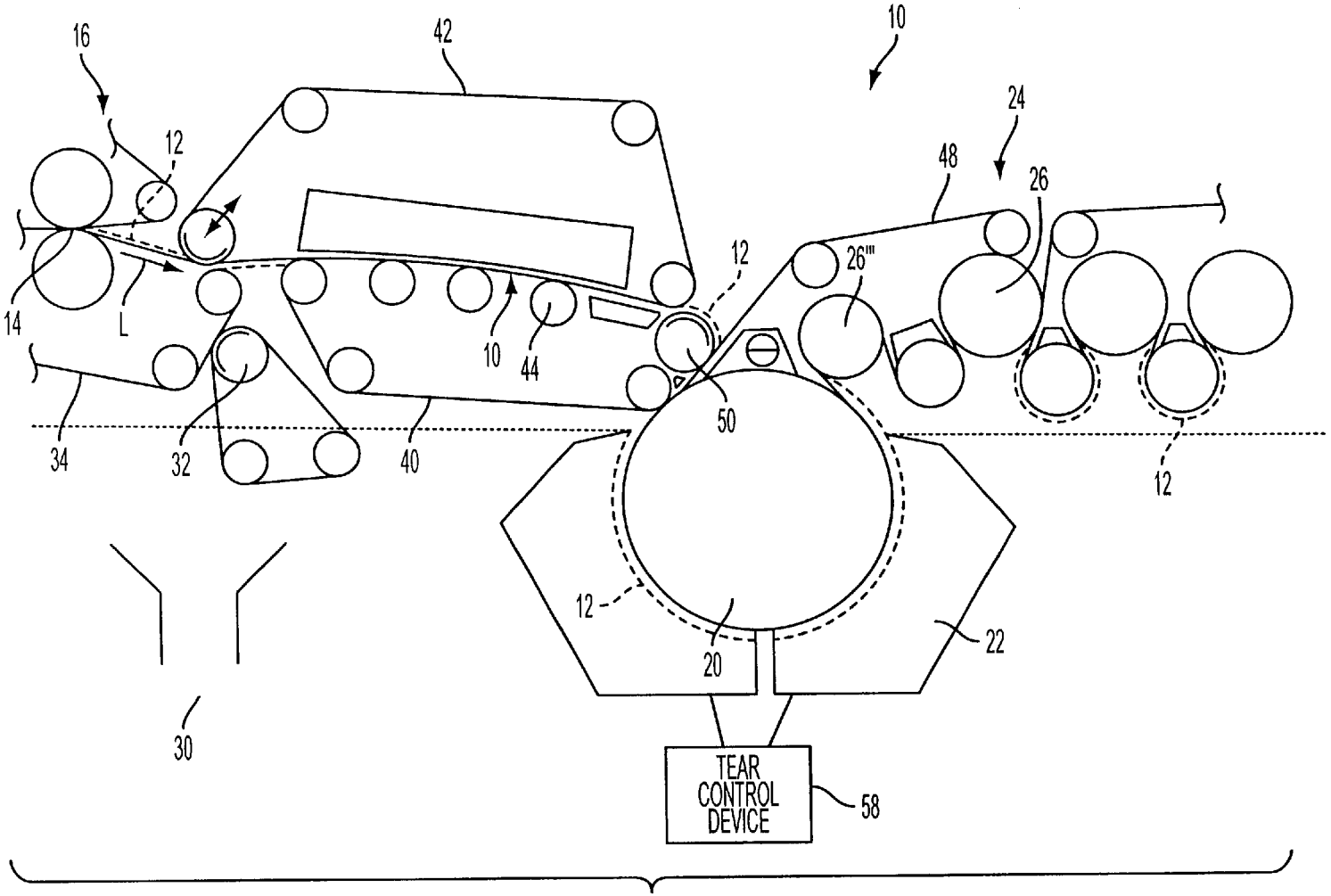
FIG. 1 schematically illustrates an initial embodiment of a drying section with a straight or slightly curved impingement drying section and a lower larger support roll with an assigned impingement dryer.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1–9 schematically illustrates a drying section 10 of a machine for producing a material web, e.g., a paper or cardboard web.

In all of the embodiments, material web 12 (depicted only in FIG. 1), as it proceeds from a last press nip 14 of a press section 16, is guided along a closed path over at least one straight or slightly curved section 18 to a larger support roll 20 with an impingement dryer 22 associated therewith. In this way, material web 12 guided over the support roll 20 is subjected to impingement with hot air and/or hot steam, while the straight or slightly curved section 18 is provided in the form of an impingement drying section and/or transfer foil section.

FIG. 1 gives a schematic depiction of an initial embodiment of this kind of drying section 10 with a straight or slightly curved impingement section 18 and a lower larger support roll 20 with an associated (assigned) impingement dryer 22. Support roll 20 is positioned in front of a drying group 24, which contains drying cylinders 26.

Figure 2:
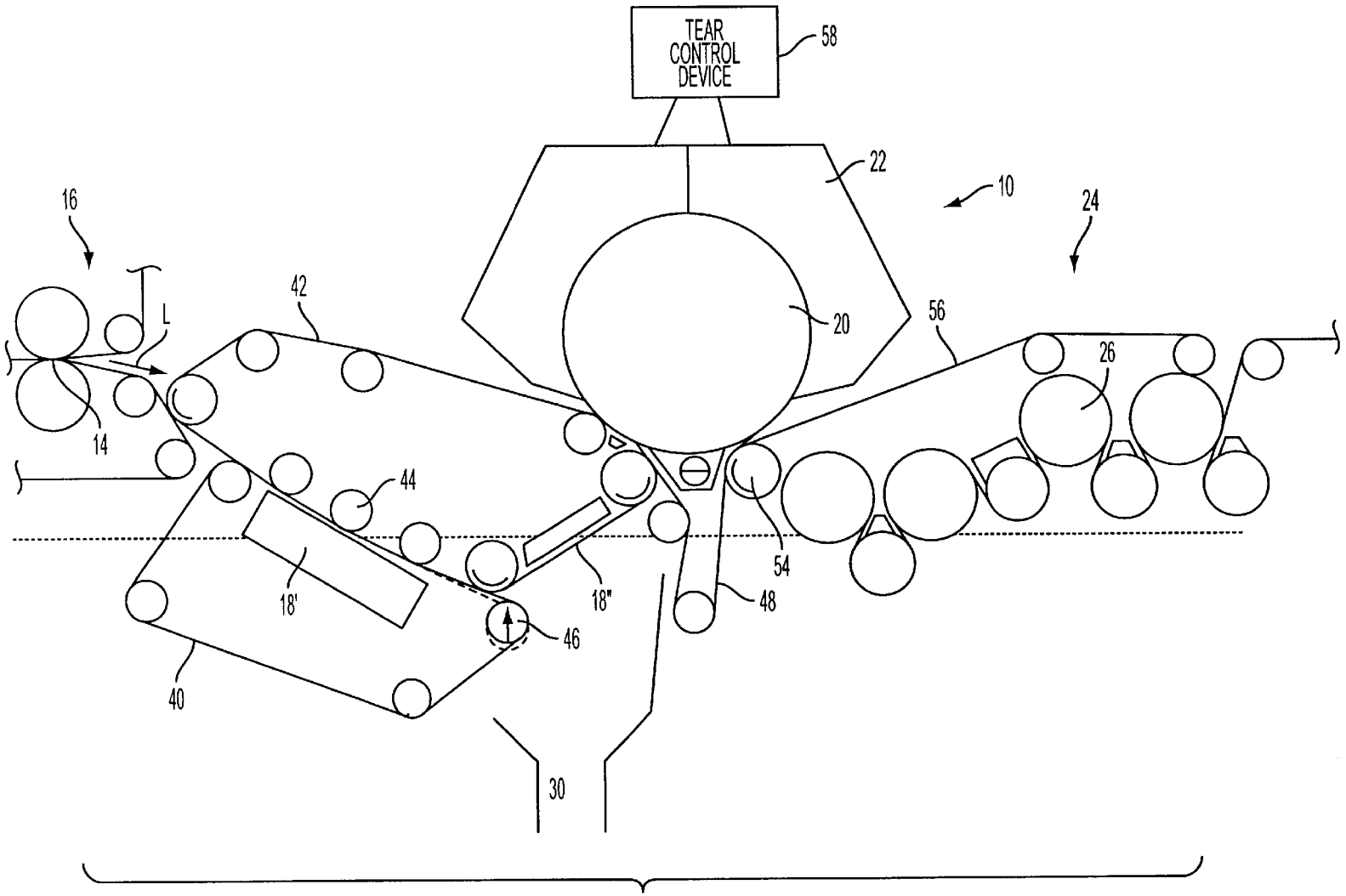
FIG. 2 schematically illustrates another embodiment of a drying section with a straight or slightly curved impingement drying section, a straight or slightly curved transfer foil section, and an upper larger support roll with an assigned impingement dryer.

FIG. 2 gives a purely schematic depiction of another embodiment of a drying section 10 with a straight or slightly curved impingement drying section 18', a straight or slightly curved transfer foil section 18", and an upper larger support roll 20 with an assigned impingement dryer 22. In this case as well, the large support roll 20 is positioned in front of a drying group 24, which contains drying cylinders 26.

Figure 3:
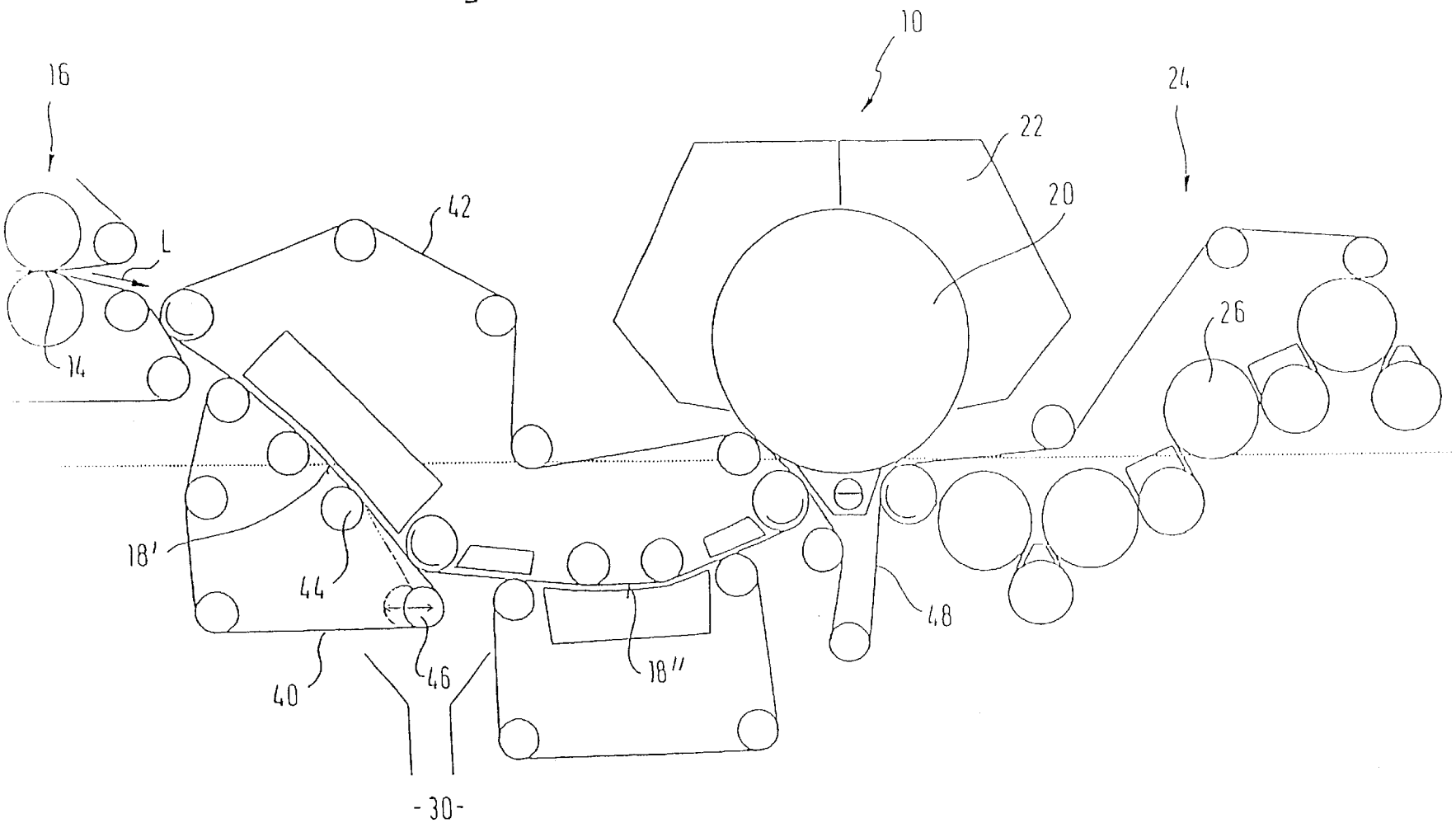
FIG. 3 schematically illustrates another embodiment of a drying section with two straight or slightly curved impingement drying and/or transfer foil sections and an upper larger support roll with an assigned impingement dryer.

FIG. 3 shows in purely schematic form another embodiment of a drying section 10 with two straight or slightly curved impingement drying and/or transfer foil sections 18' and 18", and an upper larger support roll 20 with an assigned impingement dryer 22. Here as well, the larger support roll 20 is positioned in front of a drying group 24 with drying cylinders 26.

Figure 4:
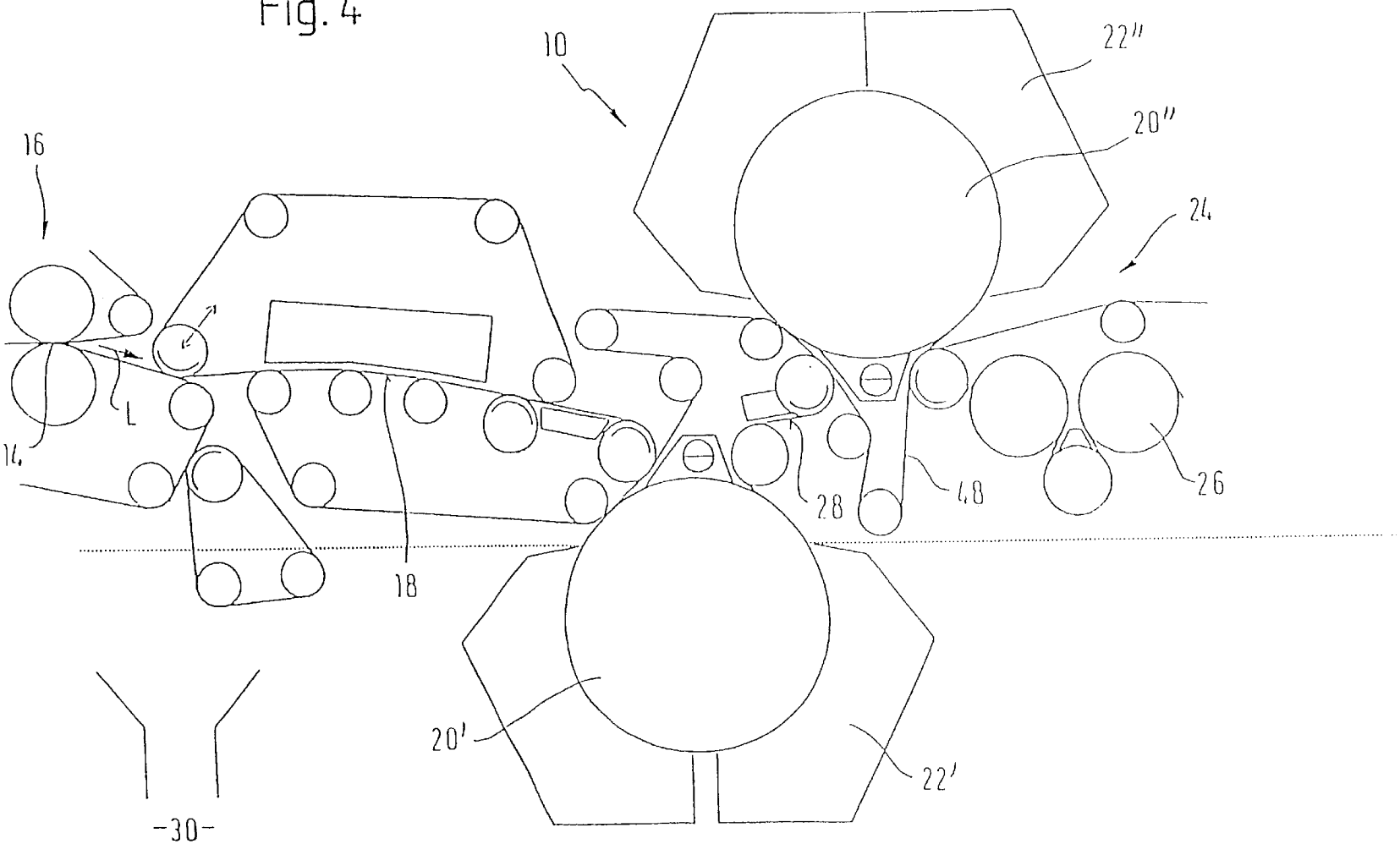
FIG. 4 schematically illustrates another embodiment of a drying section with a straight or slightly curved impingement drying section and/or transfer foil section and two larger support rolls positioned at different heights in front of a drying group with drying cylinders, each with an assigned impingement dryer.

FIG. 4 shows in purely schematic form another embodiment of a drying section 10 with a straight or slightly curved impingement drying and/or transfer foil section 18 and two larger support rolls 20' and 20", each with an assigned impingement dryer 22' and 22", positioned at different heights in front of a drying group 24 with drying cylinders 26.

Figure 5:
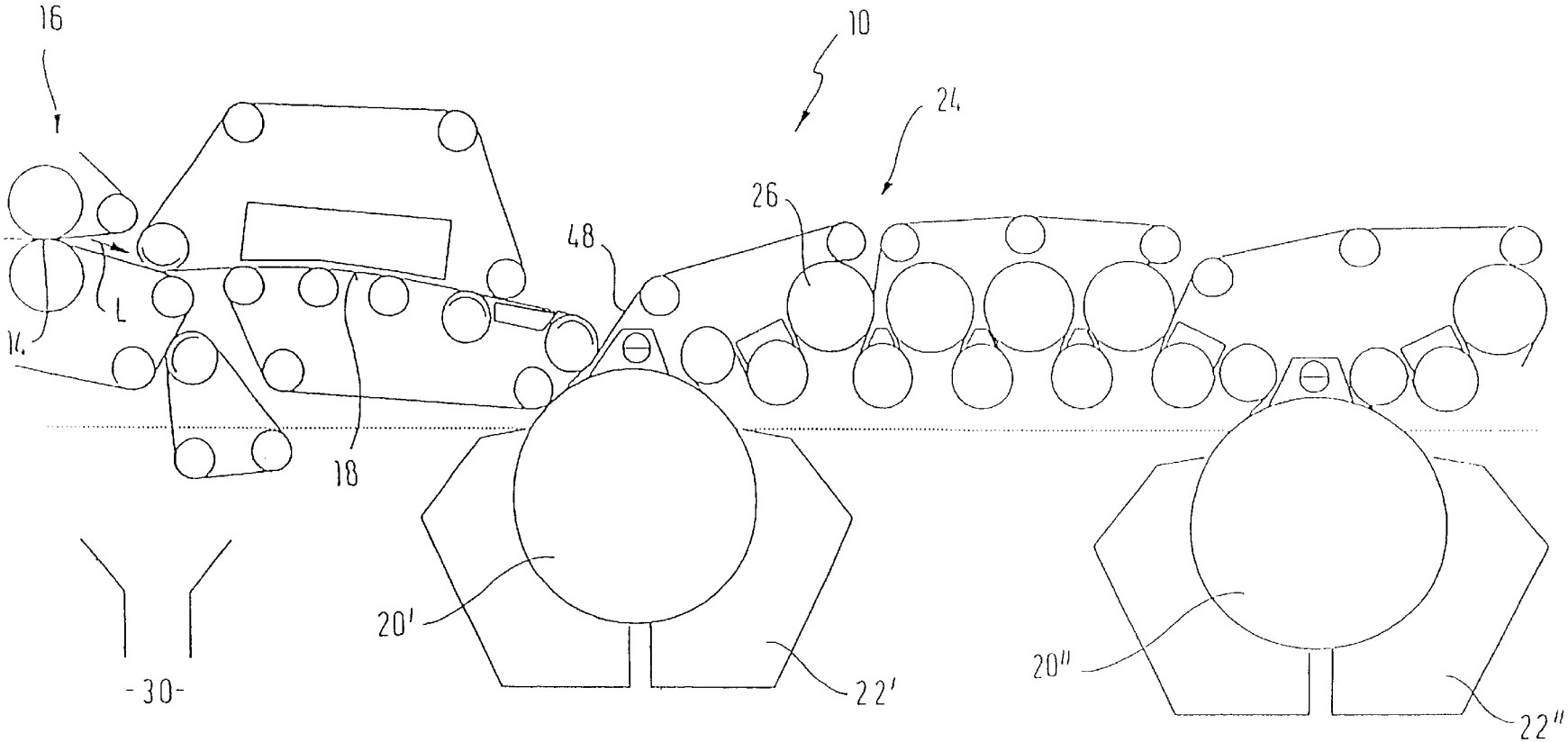
FIG. 5 schematically illustrates another embodiment of a drying section with a straight or slightly curved impingement drying section and/or transfer foil section and two lower support rolls each with an assigned impingement dryer, where one of the two support rolls is positioned in front of a drying group with drying cylinders and the other is positioned in a terminal area of the drying section.

FIG. 5 shows in purely schematic form another embodiment of a drying section 10 with a straight or slightly curved impingement drying and/or transfer foil section 18 and two lower support rolls 20' and 20", each with an assigned impingement dryer 22' and 22". Larger support roll 20' can be positioned in front of a drying group 24 with drying cylinders 26, while the other larger support roll 20" is positioned in a terminal area of the drying section 10.

Figure 6:
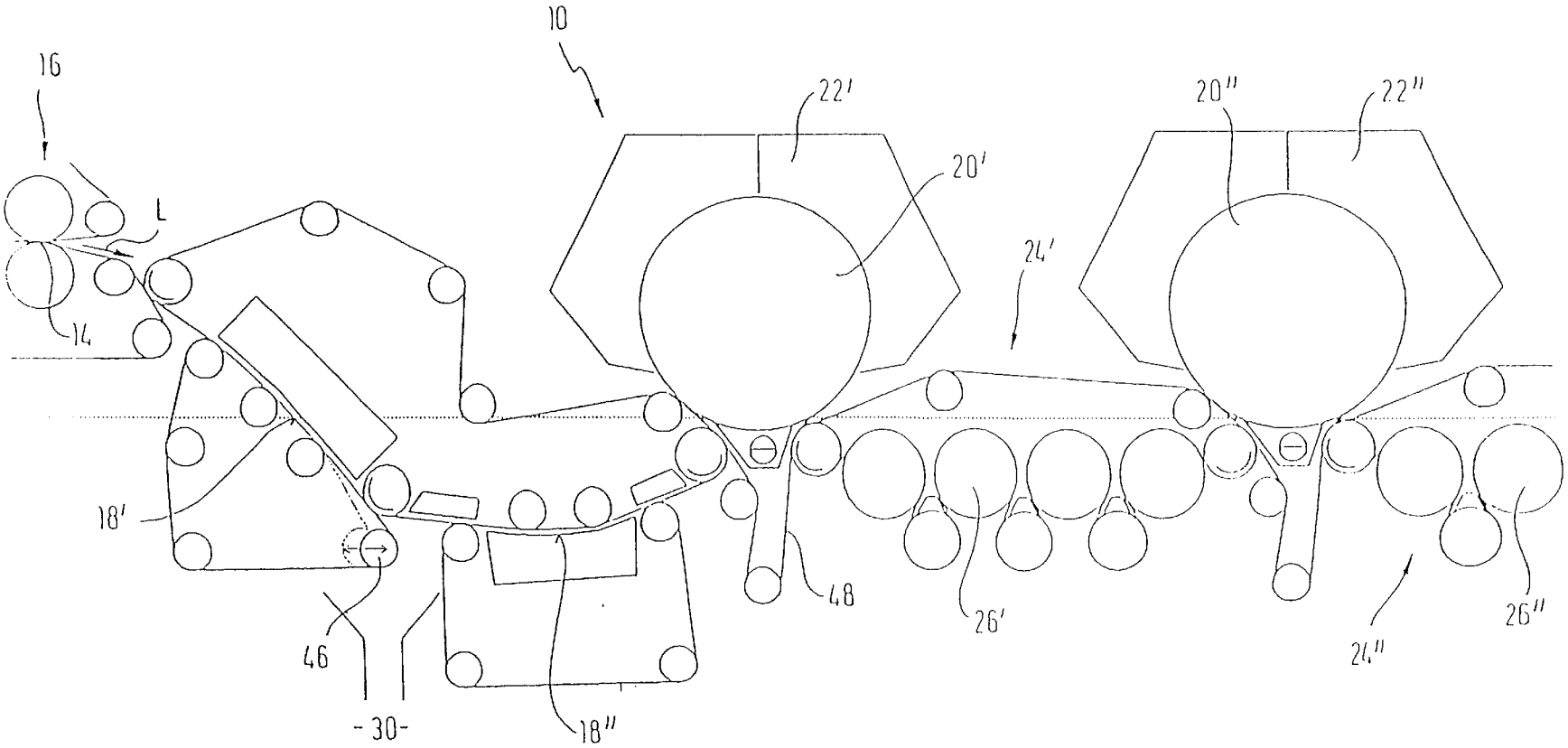
FIG. 6 schematically illustrates another embodiment of a drying section with at least two straight or slightly curved impingement drying and/or transfer foil sections and two upper support rolls each with an assigned impingement dryer, where one of the two support rolls is positioned in front of a drying group with drying cylinders and the other is positioned between this drying group and a following drying group with drying cylinders.

FIG. 6 shows in purely schematic form another embodiment of a drying section 10 with at least two straight or slightly curved impingement drying and/or transfer foil sections 18', 18" and two upper support rolls 20', 20", each with an assigned impingement dryer 22' and 22". Larger support roll 20' can be positioned in front of drying group 24' with drying cylinders 26', while the other larger support roll 20" is positioned between drying group 24' and a subsequent drying group 24" with drying cylinders 26".

Figure 7:
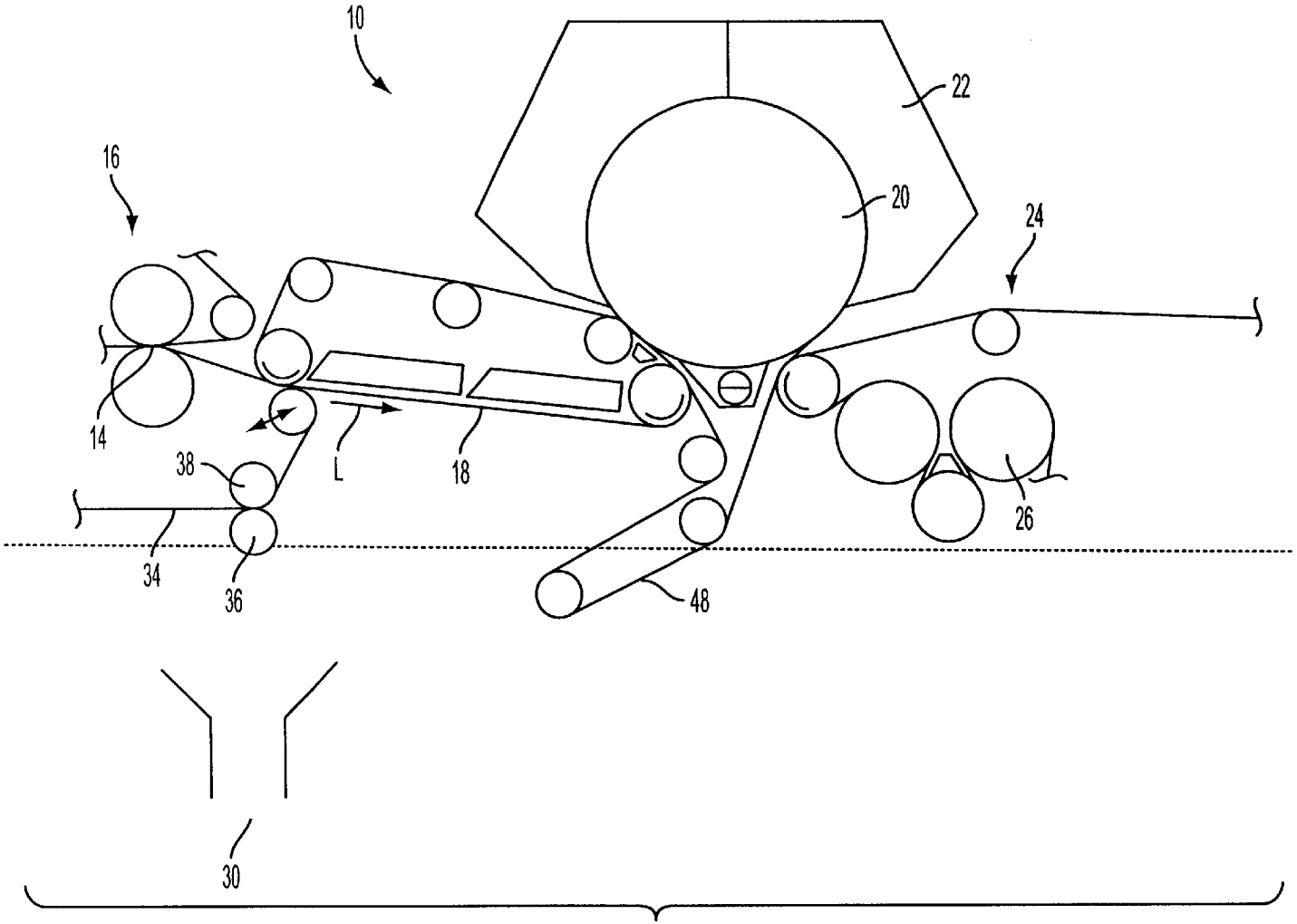
FIG. 7 schematically illustrates another embodiment of a drying section with a straight or slightly curved transfer foil section and an upper larger support roll with an assigned impingement dryer.

FIG. 7 shows in purely schematic form another embodiment of a drying section 10 with a straight or slightly curved transfer foil section 18 and an upper larger Support roll 20, with an assigned impingement dryer 22. Here as well, the larger support roll 20 is positioned in front of a drying group 24 with drying cylinders 26.

Figure 8:
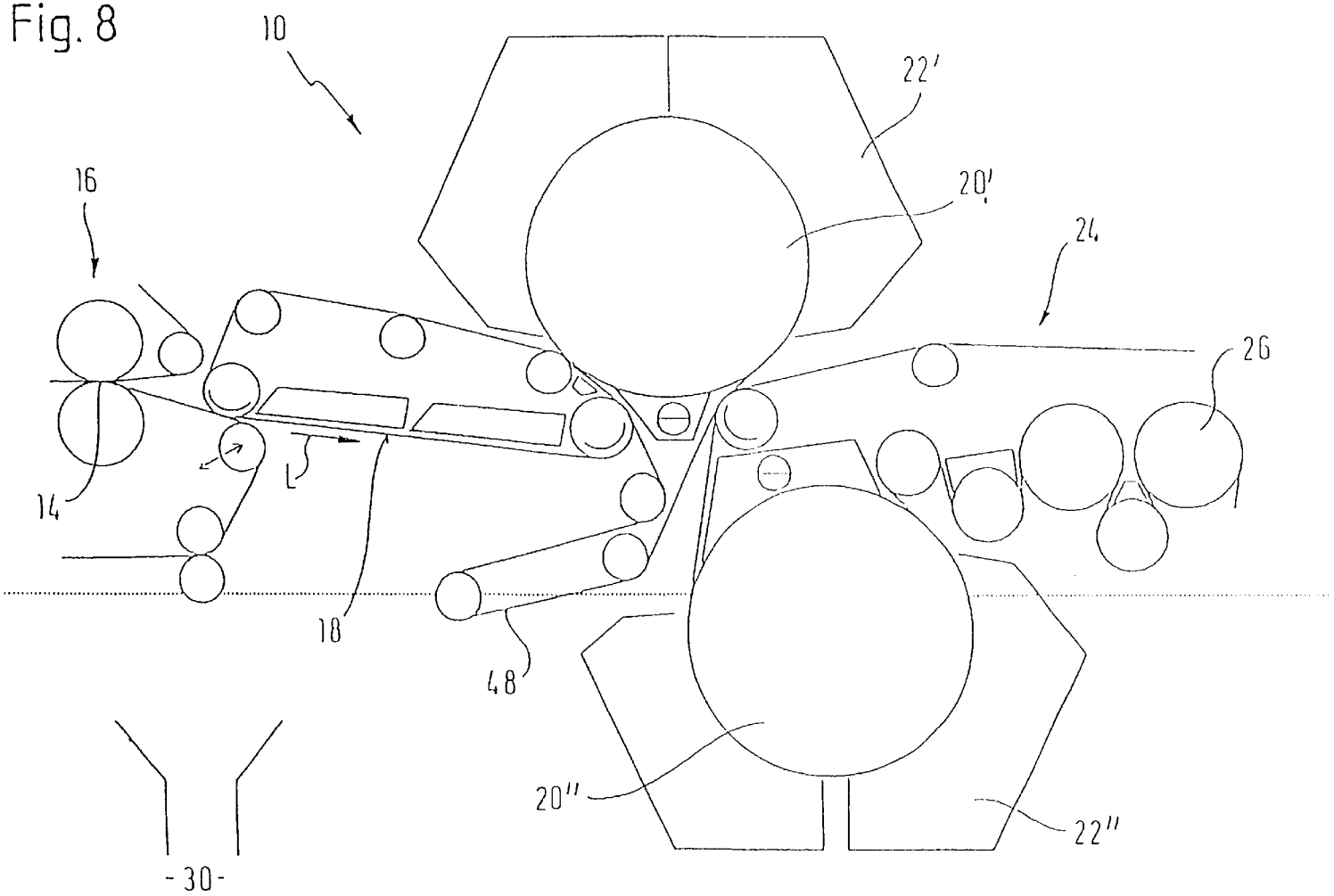
FIG. 8 schematically illustrates another embodiment of a drying section with a straight or slightly curved transfer foil section and two larger support rolls positioned at different heights in front of a drying group with drying cylinders, each with an assigned impingement dryer.

FIG. 8 shows in purely schematic form another embodiment of a drying section 10 with a straight or slightly curved impingement transfer foil section 18 and two larger support rolls 20' and 20". Each of the support rolls 20' and 20" are each assigned an impingement dryer 22' and 22", positioned at different heights in front of a drying group 24 with drying cylinders 26.

Figure 9:
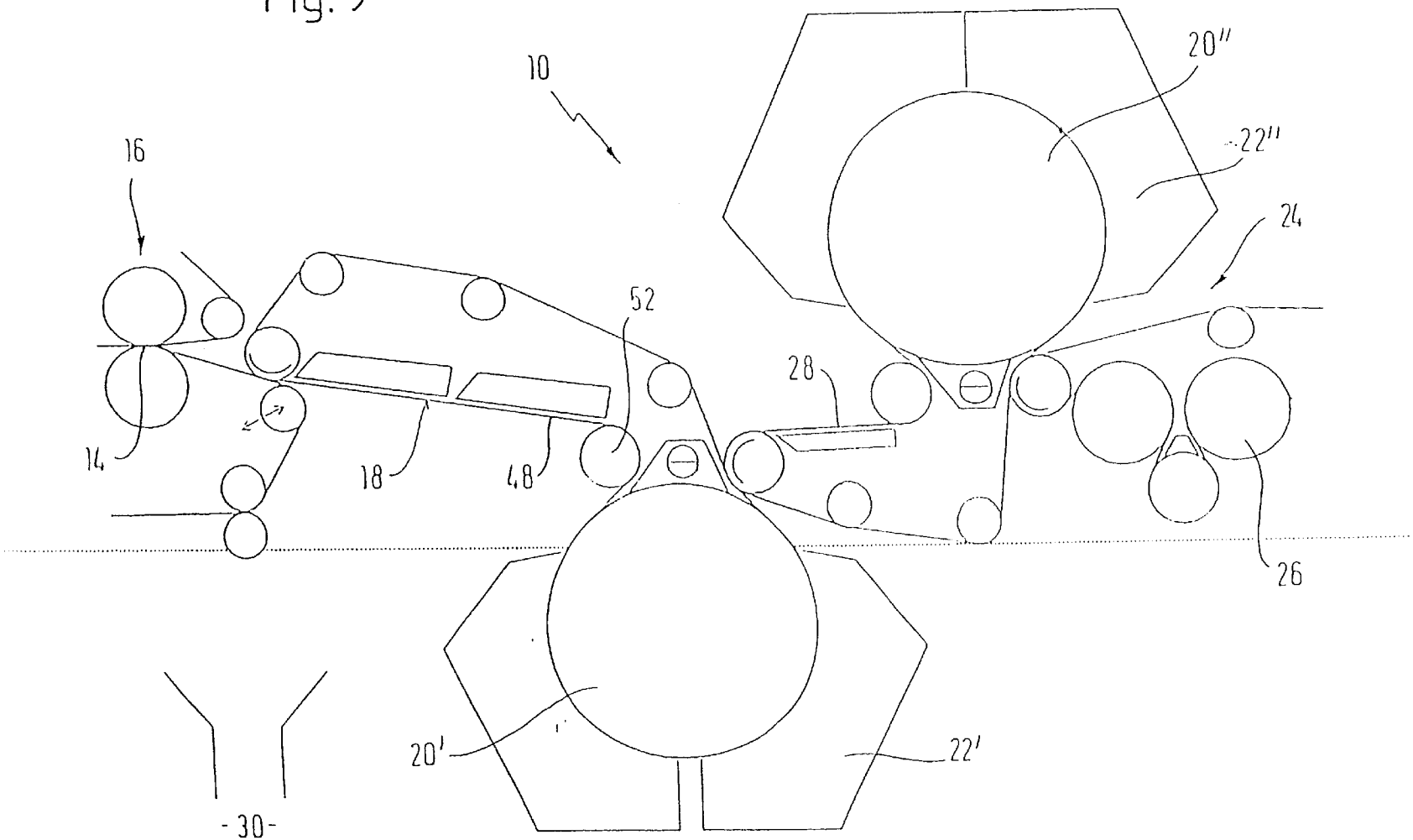
FIG. 9 schematically illustrates another embodiment of a drying section with a straight or slightly curved transfer foil section and two larger support rolls positioned at different heights in front of a drying group with drying cylinders, each with an assigned impingement dryer, where another straight or slightly curved transfer foil section is provided between the two larger support rolls.

FIG. 9 shows in purely schematic form another embodiment of a drying section 10 with a straight or slightly curved transfer foil section 18 and two larger support rolls 20' and 20", each with an assigned impingement dryer 22' and 22", positioned at different heights in front of a drying group 24 with drying cylinders 26.

In the present case, an additional straight or slightly curved transfer foil 28 is provided between the two larger support rolls 20' and 20".

In principle, impingement drying is also possible on a transfer foil section. However, such a transfer foil section can also be provided simply as a transfer section.

In order to conduct the material web from the press section to the subsequent impingement drying or transfer foil section it is possible to provide, e.g., a transfer belt.

In all the embodiments described above, there is thus combined in a closed path, following the press section 16 and allowing for the provision of a transfer belt, a straight or slightly curved impingement drying section and/or transfer foil section 18 for securely guiding the web and an adjacent impingement dryer 22 provided, e.g., with a hood or the like, positioned on a larger support roll 20, which can take over the major portion of the impingement drying. There is no pulling of the material web 12 from smooth heating areas at the beginning of drying.

The still-unstable material web to be dried can be conducted in a closed manner from the press and then dried first in at least one straight or slightly curved impingement drying and/or transfer foil section 18 and then by at least one, e.g., hooded impingement dryer 22, without the web being pulled from a smooth heated area during the time-it has a dryness content of less than, e.g., about 55 to 65% wt. The diameter of a larger support roll 20 can lie in a range, e.g., from about 2.5 to 8 m and preferably within a range from about 3 to about 5 m. After this, the material web 12 can be thoroughly dried in a single-row or double-row drying group 24 with a plurality of drying cylinders 26. Instead of a straight or slightly curved impingement drying section, it is possible to provide only a transfer foil section for transferring the web onto the large support roll.

Ideally, the material web 12 can be moved in the web travel direction L into the cellar 30 before the support roll with an assigned impingement dryer following the straight or slightly curved impingement drying or transfer foil section 18. Thus, in the embodiments shown in FIGS. 2, 3, and 6, the material web 12 can be moved into the cellar 30 following a first (seen in the web travel direction L) straight or slightly curved impingement drying or transfer foil section 18. In contrast, the material web 12 in the embodiment according to FIG. 1 can be moved into the cellar in the area of an additional pickup roll 32 by which the material web 12 can be removed by a press felt or press belt 34 guided through the last press nip 14 belonging to the press section 16.

In the embodiment according to FIG. 7, the material web 12 can be moved into the cellar 30 in the area of an additional press roll 36 lying opposite a deflection roll 38 which is provided behind the last press nip 14 of the press section 16 and which serves a press felt 34 guided through last press nip 14.

In the embodiments according to FIGS. 1 to 3, at least one straight or slightly curved impingement drying or transfer foil section 18 or 18' is provided in which the material web 12 can be securely guided between the screens 40 and 42. Material web 12 can be subjected to impingement from the upper or lower side through given screen 42 or 40.

The screen furnished on the blow side is usefully designed to withstand high temperatures and to be as permeable as possible to the impingement. The material web 12 and the dual screen are supported by the support rolls 44 which are only enclosed to the degree required for there to be no paper damage through sheering. An angle of wrapping from about 2 to about 10°, preferably from about 3 to about 7°, can be provided. In the case of a plurality of impingement dryers, e.g., formed by impingement boxes, the blow side can be alternated. As an alternative, the material web 12 can be secured to the screen by transfer foils. The second or cover screen can then be omitted. Here, the blowing can be performed directly on the material web 12 by the impingement dryer. It is also possible, however, for the impingement boxes to be omitted, in part or entirely, and this portion of the straight or slightly curved section can then replaced by a pure transfer section, as can be seen in the embodiments shown in FIGS. 2 and 7. The impingement drying or transfer foil section can run horizontally or at an incline.

As already mentioned, the web cut between the press section 16 and the first larger support roll 20 or 20' can be made, e.g., after an initial first double screen section, from the drying screen into the pulper or the cellar 30. To this end, a movable roll 46 can be provided that is supported by water or air jets behind the screen, as shown in FIGS. 2, 3, and 6.

The web cut can also be made, however, by another pickup roll in the vicinity of an additional removal point belonging to the second lower felt. Thus, in the embodiments according to FIGS. 1, 4, and 5, the material web 12 can be conducted into the cellar 30 in the vicinity of a pickup roll 32. Via pickup roll 32, the material web 12 is removed from a press felt 34, which is guided through the last press nip 14 belonging to the press section 16.

The web cut can also be made, e.g., by an additional press nip. Thus, in the embodiment according to FIG. 7, the material web 12 can be conducted into the cellar in vicinity of an additional press roll 36 which lies opposite a deflection roll 38, which is provided behind the last press nip 14 belonging to the press section 16 and which serves press felt 34, which is guided through last press nip 14.

As can be seen in FIGS. 1 to 9, the support rolls 20, 20' and 20" assigned to the impingement dryers 22, 22', and 22" can be provided with suction, and a continuous screen 48 can be guided over these support rolls. In the embodiments according to FIGS. 1 and 5, this screen is also assigned simultaneously to the drying group 24, in the embodiments according to FIGS. 2 to 4 and 6 to 8, a separate screen is assigned to the support roll 20 or 20'. In the embodiment according to FIG. 9, for example, the given screen is simultaneously assigned to the transfer foil section 18.

The given support roll can be provided with suction directly by an internal suction box or by an external suction box through openings provided in the jacket surface. With an increasing diameter, not only does the roll circumference increase, but the possible angle of wrap for the hood, and thus the drying area, also increases. The given impingement hood can rest above or below the cylinder plane and ideally can be moved in parts for the purpose of transfer and for maintenance/cleaning. Moreover, a tear control device 58 can be coupled to the movable impingement hood parts. A given large support roll and the corresponding suction box can contain small transfer zones. In the case of several large support rolls with assigned impingement hoods, it is possible to dry from both sides in alternating fashion (see, e.g., FIG. 4). It is also possible, however, for drying to always proceed from the same side and for the web to be transported between the large support rolls on a straight or slightly curved impingement drying or transfer foil section. In the embodiment according to FIG. 9 at least one straight or slightly curved impingement dryer or transfer foil section 28 is again positioned between two impingement dryers 22' and 22" with an assigned support roll 20' and 20".

The material web 12 can be delivered from the preceding screen to the adjacent larger support roll 20, which is provided with suction, e.g., by a suction box positioned in front of or upon the large support roll 20 in the vicinity of the delivery zone (see, e.g., FIGS. 1 and 7). Here, it is useful for air entrained by the screen to be scraped in front of the intake into the nip, e.g., with a flexible blade, or to be sucked from the box into a preliminary zone. Removal can be additionally supported by blow jets, which are, e.g., integrated in the smaller suction roll or in the intermediate space. With these blow jets, the material web is either blown upon through the screen or is blown upon from the hood rim to the large roll that is provided with suction. As can be seen from FIG. 1, a screen 40 belonging to the impingement drying or transfer foil section 18 can be guided over a smaller suction roll in front of the larger support roll 20. A portion of this kind of smaller suction roll can be designed as an overpressure zone, or an overpressure box can be installed in the intermediate space in order to push the material web 12 away from the preceding screen, in this case, screen 40.

For example, in this embodiment according to FIG. 1, the material web 12 is delivered from a screen 40 belonging to a straight or slightly curved impingement drying or transfer foil section 18 to a screen 48 guided over the following larger support roll 20, while the delivery area is provided with suction by a suction box provided in front of or on the support roll 20.

In contrast, FIG. 9 shows an embodiment in which a screen 48 assigned to a straight or slightly curved impingement drying or transfer foil section 18 is simultaneously guided over the subsequent larger support roll 20' and the material web is brought onto the support roll 20' in the vicinity of a guide or blow roll 52, with this support roll 20' assuring that the web is successfully released.

The guide roll can be equipped with air jets in front of the web approach point so as to create an air cushion and thus assure successful detachment of the web. The jets can be integrated into, e.g., a scraper. When there is a blow roll, the blow roll can be covered with screen stocking.

When the impingement dryer 20 lies below (see, for example, FIG. 1), the material web 12, following the larger support roll 20, can be guided with the screen 48 directly onto an unheated paper guide roll or a drying cylinder 26'''. The scraper should be combined with a deflection sheet or with a hood, i.e., with the impingement dryer, in such a way that, even when the hood is open, paper from the scraper cannot fall into the hood or lead to blockages. This paper guide roll 26''' can also take the form of a blow roll (possibly with a screen stocking), which permits easy removal of the web.

When the impingement dryer 20 lies above (see, for example, FIG. 2), the material web can be removed from the screen 48 belonging to the larger support roll 20 by a suction roll 54 in such a way that in the case of a tear the paper can fall between the screens 48 and 56 into the cellar.

Delivery between two larger suction rolls positioned in succession can take place in an analogous fashion.

The useful conditions for impingement drying mentioned above also apply for the embodiments depicted in FIGS. 1 to 9.

As can be seen, e.g., particularly in FIG. 2, depending on the diameter of the larger support roll 20 or support rolls, it can be advantageous to position some of the subsequent drying cylinders 26 at a lower level.

For example, it can be seen from FIGS. 5 and 6 that, to further increase the performance in primary vaporization, at least one other impingement dryer 22', or at least one other impingement hood, with an assigned larger support roll 20", can be inserted in the area of the cylinder drying system, either above or below the cylinder plane. The individual larger support rolls can have the same or differing diameters.

If refuse removal after the press section 16 is not performed with a second pickup roll on the last press felt, but rather on a straight or slightly curved impingement drying or transfer foil section, the embodiments shown in FIGS. 1 to 9 can also be combined with means for removing the web from the upper press felt. Particularly in the area of the first straight or slightly curved impingement drying or transfer foil section, or where the impingement hood starts, it is possible to provide, among other things, additional IR emitters for the sake of faster heating.

It is noted that the foregoing examples have been provided. merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 10 | drying section |
| 12 | material web |
| 14 | press nip |
| 16 | press section |
| 18 | impingement drying and/or transfer foil section |
| 20, 20', 20" | larger support roll |
| 22, 22', 22" | impingement dryer |
| 24, 24', 24" | drying group |
| 26, 26', 26" | drying cylinder |
| 26"' | paper guide roll or drying cylinder |
| 28 | transfer foil section |
| 30 | cellar |
| 32 | pickup roll |
| 34 | press felt |
| 36 | additional press roll |
| 38 | deflection roll |
| 40 | screen |
| 42 | screen |
| 44 | support rolls |
| 46 | movable roll |
| 48 | screen |
| 50 | small suction roll |
| 52 | guide or blow roll |
| 54 | suction roll |
| 56 | screen |
| L | direction of web travel |

What is claimed:

1. The drying section of a machine for producing a material web comprising:

a support roll with an associated impingement dryer;

at least one straight or curved section forming at least a part of a closed path between a last nip of a press section adjacent said drying section and said support roll;

said support roll and said impingement dryer being arranged to guide the material web over said support roll, and, thereby, subject the material web to at least one of hot air and hot steam impingement; and said at least one straight or slightly curved section being structured and arranged to form at least one of an impingement drying section and a transfer foil section.

2. The drying section in accordance with claim 1, wherein said material web comprises one of a paper and cardboard web.

3. The drying section in accordance with claim 1, further comprising one of a continuous belt or screen arranged to form an open support area, at least in an area between the last press nip and said support roll.

4. The drying section in accordance with claim 3, wherein said open support area is not smooth.

5. The drying section in accordance with claim 3, wherein another open support area is formed in an area of said impingement dryer, wherein said another open support area is formed one of by the surface, covering or coating of said support roll and by a surface of a one of a continuous belt and screen guided over said support roll.

6. The drying section in accordance with claim 1, wherein said support roll has an outer diameter in a range between about 2.5 to about 8 m.

7. The drying section in accordance with claim 6, wherein said support roll has an outer diameter in a range between about 3 to about 5 m.

8. The drying section in accordance with claim 1, further comprising a plurality of impingement dryers of which each is associated with a support roll.

9. The drying section in accordance with claim 1, further comprising a dryer section including at least one drying cylinder which is arranged downstream from said support roll, relative to a web run direction.

10. The drying section in accordance with claim 9, wherein said material web, upon one of leaving a first drying cylinder and being drawn from a smooth heated surface, has a dryness content that is greater than about 55 to about 65% wt.

11. The drying section in accordance with claim 1, further comprising a cellar positioned in front of said support roll, relative to a web run direction.

12. The drying section in accordance with claim 11, wherein said cellar is arranged to follow said at least one straight or slightly curved section, relative to a web run direction.

13. The drying section in accordance with claim 11, further comprising an additional pick-up roll arranged to transport the material web into said cellar, wherein the material web is removed from one of a press felt guided through the last press nip and a press belt.

14. The drying section in accordance with claim 13, wherein said press belt is one of an open and closed belt.

15. The drying section in accordance with claim 11, further comprising an additional press roll and a deflection roll arranged opposite each other, wherein the deflection roll is located within a press felt loop which passes through the last press nip, and wherein said additional press roll is arranged to transport the material web from the press felt to said cellar.

16. The drying section in accordance with claim 11, further comprising a smooth removal roll that is encircled by one of a press felt and press belt guided through the last press nip and that is arranged to transport the material web into said cellar.

17. The drying section in accordance with claim 1, wherein said at least one straight or slightly curved section comprises two screens arranged such that the material web is guided through the two screens.

18. The drying section in accordance with claim 1, wherein said at least one straight or slightly curved section comprises a screen and transfer foils, which are arranged to hold the material web onto the screen.

19. The drying section in accordance with claim 1, wherein said support roll comprises a suction roll and a narrow strip transfer zone.

20. The drying section in accordance with claim 12, wherein said suction roll is coupled to one of an internal suction box and an external suction box.

21. The drying section in accordance with claim 1, wherein at least two impingement dryers are positioned on a same side of the material web.

22. The drying section in accordance with claim 1, wherein at least two impingement dryers are positioned on different sides of the material web.

23. The drying section in accordance with claim 1, wherein said at least one straight or slightly carved section is arranged between two impingement dryers which are each assigned to a support roll.

24. The drying section in accordance with claim 1, wherein said at least one impingement dryer is arranged in an area which is not at a direct starting area of the drying section.

25. The drying section in accordance with claim 24, wherein said at least one impingement dryer is arranged only after at least one a plurality of drying cylinders.

26. The drying section in accordance with claim 1, wherein said at least one impingement dryer comprises at least one dryer hood.

27. The drying section in accordance with claim 14, wherein said at least one hood is swivelable.

28. The drying section in accordance with claim 15, wherein said swivelable hood is coupled to a tear control system.

29. The drying section in accordance with claim 1, wherein said at least one straight or slightly curved section comprises a screen and the material web is transferred from said screen to a support roll screen guided over said support roll, wherein a transfer area includes a suction box arranged one of in front of and on said support roll.

30. The drying section in accordance with claim 1, wherein said at least one straight or slightly curved section comprises a screen which is simultaneously guided over said support roll, wherein the material web is guided onto said support roll in an area of one of a guide and blow roll.

* * * * *